United States Patent [19]

Kawamura

[11] Patent Number: 4,504,979

[45] Date of Patent: Mar. 19, 1985

[54] NECKTIE ASSEMBLY

[75] Inventor: Hironobu Kawamura, Tokyo, Japan

[73] Assignee: Kawamura Shouji Kabushiki Kaisha, Tokyo, Japan

[21] Appl. No.: 500,097

[22] Filed: Jun. 1, 1983

[51] Int. Cl.[3] ..... A41D 25/14

[52] U.S. Cl. ..... 2/153; 2/144

[58] Field of Search ..... 2/152 R, 148, 146, 153; 24/49 S

[56] References Cited

U.S. PATENT DOCUMENTS

| | | | |
|---|---|---|---|
| 704,569 | 7/1902 | Oppenheimer | 2/146 |
| 1,438,885 | 12/1922 | Almedia | 2/153 |
| 1,890,722 | 12/1932 | Davis | 2/146 |
| 2,094,487 | 9/1937 | Gernert | 2/153 |
| 2,142,322 | 1/1939 | Martin | 2/153 |
| 2,473,593 | 6/1949 | Lambrechts | 2/153 |
| 2,710,408 | 6/1955 | Lackland | 2/153 |
| 3,365,726 | 1/1968 | Pulitzer | 2/153 |
| 3,737,917 | 6/1973 | Orr | 2/DIG. 6 X |
| 4,206,513 | 6/1980 | Collins | 2/152 R |

FOREIGN PATENT DOCUMENTS

| | | | |
|---|---|---|---|
| 51843 | 5/1982 | European Pat. Off. | 2/148 |
| 2325653 | 5/1973 | Fed. Rep. of Germany | 2/148 |

*Primary Examiner*—Henry S. Jaudon
*Assistant Examiner*—Tracy G. Graveline
*Attorney, Agent, or Firm*—Burns, Doane, Swecker & Mathis

[57] ABSTRACT

A necktie assembly easily fittable and removable to a wearer's neck without tying or untying a knot thereof, which comprises a tie body having a shape similar to a traditional tie and a knot formed by tying a part of the tie body around a core body. The core body has a channel by which a free end of the tie body can be inserted into the knot while keeping a neatly folded shape thereof. The necktie assembly may have a pin or the like built-in the core body for securing the necktie.

6 Claims, 18 Drawing Figures

NECKTIE ASSEMBLY

FIELD OF THE INVENTION

The present invention relates to a necktie assembly which need not be knotted when fitted to the neck and which can easily detached.

DESCRIPTION OF THE PRIOR ART

In the past, numerous proposals have been made for neckties which can be detached while knotted, thus eliminating the troublesome knotting operation. These neckties, however, have had strange appearances compared to traditional ties or have been easily damaged in a short period of use due to their complicated structures.

Japanese Examined Utility Model Publication (Kokoku) No. 40-21052, for example, discloses a necktie comprising a wide front band, part of which forms a knot, and a string inserted through the knot to form a loop for fitting to a wearer's neck. This tie, however, has the drawbacks of easy deformation of the knot formed of the wide band and the strange appearance caused by the large difference between the width of the string and the band when the string happens to appear from under the collar of a wearer's shirt.

Japanese Examined Utility Model Publication (Kokoku) No. 53-15444 discloses a triangular core body inserted into a knot of a tie body for maintaining the knot shape and for allowing easy sliding of a narrow band of the tie body through the knot when the tie is fitted to or removed from the neck. However, the necktie still tends to deform due to distortion of the narrow band or displacement of a folded line thereof after repeated use.

SUMMARY OF THE INVENTION

It is an object of the present invention to eliminate the above-mentioned problems of the prior art.

It is another object of the present invention to provide a necktie assembly having a core body within a knot for maintaining an elegant knot shape and for enhancing the sliding of a narrow band through the knot.

The above objects can be achieved by a necktie assembly comprising a tie body consisting of a wide and a narrow bands longitudinally connected to each other and a core body, a knot being formed by tying the tie body around the core body and a loop being formed by slidably inserting a free end of the narrow band into a channel provided through the core body, the necktie assembly being characterized in that the channel of the core body is of a U-shaped cross section to allow the free end of the narrow band being inserted while keeping a double folded state.

BRIEF DESCRIPTION OF THE DRAWINGS

The present invention will be described more fully with reference to the accompanying drawings; in which

FIG. 1 is a cross-sectional view of the core body showing a second embodiment of a securing means.

DESCRIPTION OF THE PREFERRED EMBODIMENTS

Figure 1:
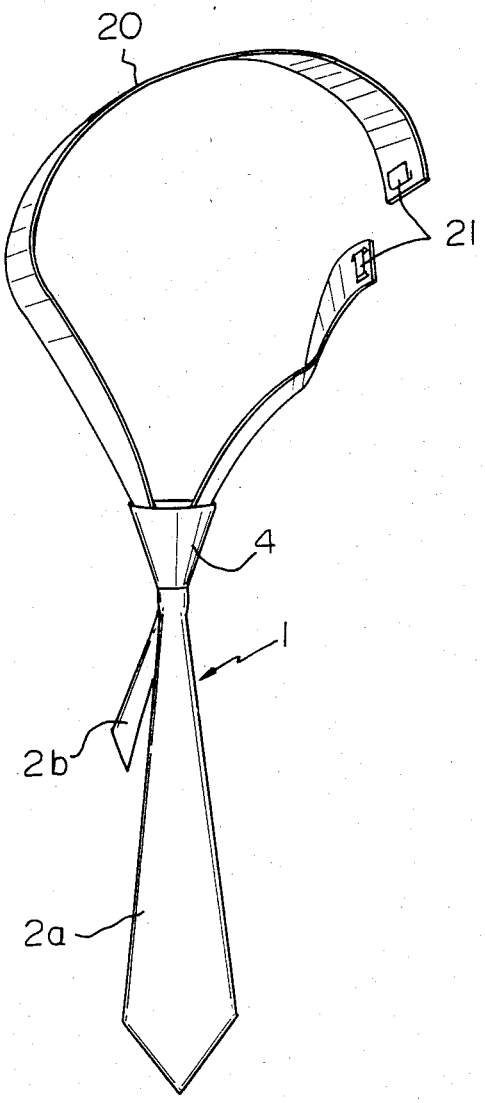
FIG. 1 is a front view showing use of the necktie assembly.
Figure 2:
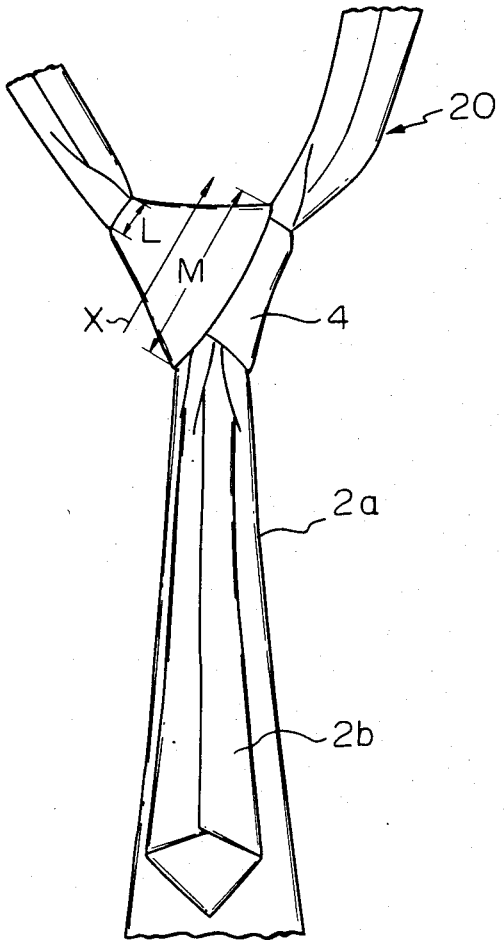
FIG. 2 is a back view of a main part of the necktie assembly.

FIGS. 1 and 2 illustrate appearances of a necktie assembly 1 according to the present invention. The necktie assembly 1 is mainly formed of a tie body 2 made from an outer cloth of natural fibers or synthetic fibers and interlinings wrapped in the outer cloth. The tie body 2 has two portions, a wide band 2*a* and a narrow band 2*b*, longitudinally connected to each other to form a linear piece. The tie body 2 also has a knot 4 near the border between the wide and narrow bands 2*a* and 2*b*.

Figure 4:
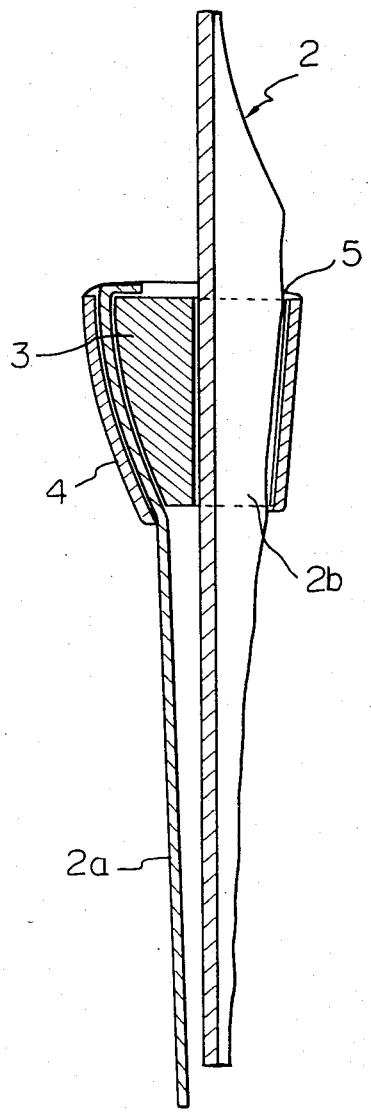
FIG. 4 is a sectional view of the necktie assembly along the longitudinal center line thereof.

As shown in FIG. 4, the knot 4 is formed by tying a middle portion of the tie body 2 around a core body 3 so that the core body 3 is wrapped within the knot 4 and a free end of the wide band 2*a* is hung down from the knot 4. A free end of the narrow band 2*b* is inserted into the knot so as to pass through a channel 5 provided through the core body. Therefore as shown in FIG. 1, the knot 4 is provided with an adjacent loop 20 of the narrow band 2*b* which serves for encircling a wearer's neck. The loop 20 can be adjusted in size by adjusting the length of the free end portion of the narrow band 2*b* extending from the knot 4 and, thereby, can be detached from or fitted on the neck. The loop 20 may have a detachable fastener 21, such as a clasp or a snap hook, for easier attachment or detachment.

Figure 3:
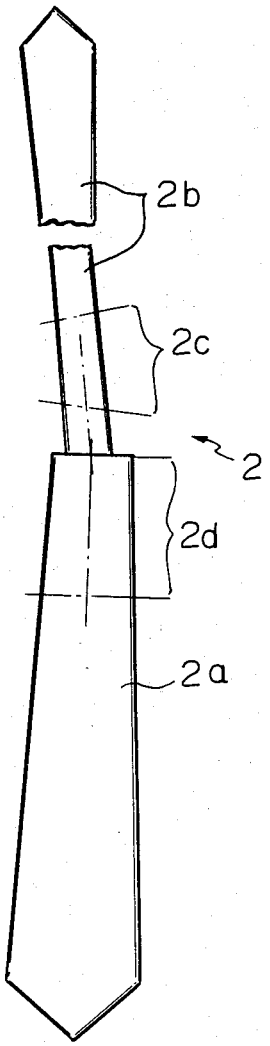
FIG. 3 is a front view of an example of a tie body suitable for the present invention.

The tie body may be of the usual form of a traditional tie, however, it preferably has a stepped form as shown in FIG. 3, in which the narrow band 2*b* and the wide band 2*a* are obliquely connected to each other with a width difference at the connected end. This form is convenient for forming an elegant knot. This is because the narrow band 2*b* forming the knot 4 has to run obliquely in the rear side of the knot as shown by an arrow X in FIG. 2, causing lengths L and M of either edge of the narrow band 2*b*, the difference of which can be compensated by the oblique connection of the bands 2*a* and 2*b*, and, as a result, a symmetrical front view of the tie being obtained.

Further, near to the connected end, the bands 2*a* and 2*b* preferably have certain lengths 2*c* and 2*d*, respectively, in which harder interlinings are additionally wrapped in. Positions and sizes thereof are selected so that the most conspicuous part of the tie around the knot can be formed therewith for maintaining the shape thereof constant even after the repeated use.

Figure 5:
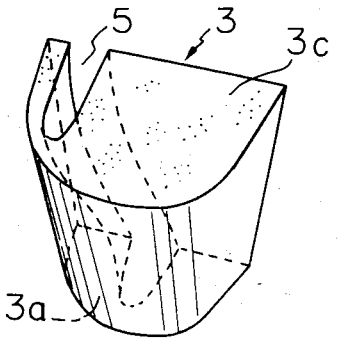
FIG. 5 is a perspective view of an embodiment of a core body utilized for the present invention.

The core body 3 utilized for forming the knot 4 can be made of any material having a suitable rigidity, for example, wood or plastic. As shown in FIG. 5, the shape of the core body 3 is substantially an inverse triangle in the front view. A front wall 3*a* thereof is of a converged conical surface, while a rear wall 3*b* thereof is of a flat surface. Top and bottom surfaces 3*c* and 3*d* are flat and parallel to each other. The rigidity of the core body 3 maintains the shape of the knot 4 formed by a method described later.

Figure 6:
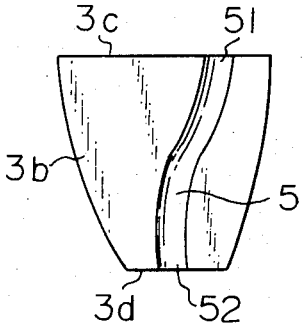
FIG. 6 is a back view of the same embodiment as shown in FIG. 5.

To ensure a good appearance when fitted, it is important that a portion of the narrow band 2*b* slidably inserted to the knot 4 be evenly folded along a length thereof. Conventional core bodies did not take this point into consideration, and, thus, the narrow band tended to twist or reverse during repeated loosening and tightening operation. According to the present invention, the core body 3 has the channel 5 bored from the top surface 3*c* and the bottom surface 3*d* for neatly inserting the narrow band 2*b*, as shown in FIGS. 5 and 6. The channel 5 has an inlet 51 on a left-sided portion of the top surface 3*c* in the front view and an outlet 52 on a middle portion of the bottom surface 3*d*. The rear side of the channel 5 is open. The depth of the channel 5 is larger than the width thereof so that the narrow band 2*b* can slide therethrough while keeping its double folded shape through engagement with the inner wall of the channel 5. The curvature of the channel between the inlet 51 and the outlet 52 imparts a suitable resistance to the movement of the narrow band 2*b* and keeps it in the fixed state.

Figure 7:
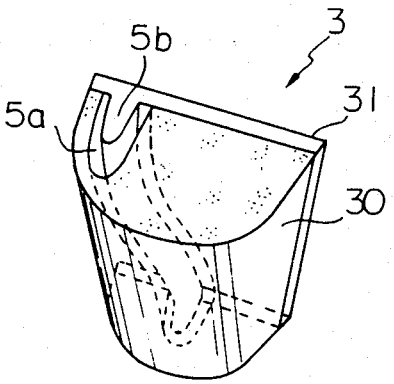
FIG. 7 is a perspective view of another embodiment of the core body utilized for the present invention.

In FIG. 7, another embodiment of the core body 3 is illustrated, which is fabricated with a main piece 30 and a back plate 31. The main piece 30 is substantially of the same shape as the first embodiment shown in FIG. 5. The back plate 31 is fittable to the rear wall of the main piece 30 in such a manner that a curved rib 5*b* provided on a surface of the back plate 31 is engaged into a channel of the main piece, thereby a channel 5*a* having a U-shaped cross section is formed therebetween. The rib 5*b* serves as a guide for neatly folding a narrow band 2*b*.

The knot 4 is preferably formed by the following steps:

1. Inserting a free end of the narrow band 2*b* into the channel 5 of the core body 3 under a double folded state, and in the case of the embodiment shown in FIG. 7, attaching the back plate 31 to the main body 30, 2. Tying a knot around the core body 3 with a middle portion of the tie body 2 in the same manner as tying a traditional necktie, and 3. Fixing the knot by sewing the layers of the tie body to each other or by adhering it to the core body 3.

Figure 8:
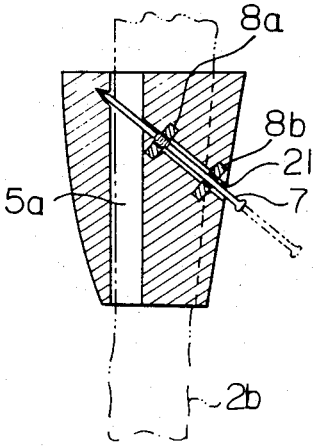
FIG. 8 is a sectional view of the core body of FIG. 5 showing a securing means.
Figure 9:
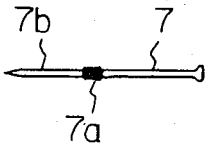
FIG. 9 is a side view of a pin utilized for the securing means shown in FIG. 8.

The tie assembly according to the present invention may have a means for securing the narrow band 2*b* in the core body 3. FIG. 8 shows an embodiment of a means in which two nuts 8*a* and 8*b* are separately embedded as a holder in the core body 3 midway of a hole 21 bored from the rear surface 3*b* to the inner wall of the channel 5*a*. A pin 7 with a threaded portion 7*a* and a tip portion 7*b* is inserted along the hole 21.

The pin 7 is kept in the hole 21 by engagement of the threaded portion 7*a* with the outer nut 8*b*. A rear end of the pin 7 protrudes backward from the hole 21 and further from the knot 4 through a space between the layers of the tie body 2 forming the knot 4. In this position, the tip portion 7*b* of the pin 7 hides in the hole 21. When the tie is fitted to the wearer's neck, the pin 7 is moved forward by screwing and, after disengagement with the outer nut 8*b*, is pushed toward the channel 5 so that the tip portion 7*b* pierces the narrow band 2*b* in the channel 5*a*. The pin 7 is further screwed with the inner nut 8*a* to maintain the operative position thereof.

Figure 16:
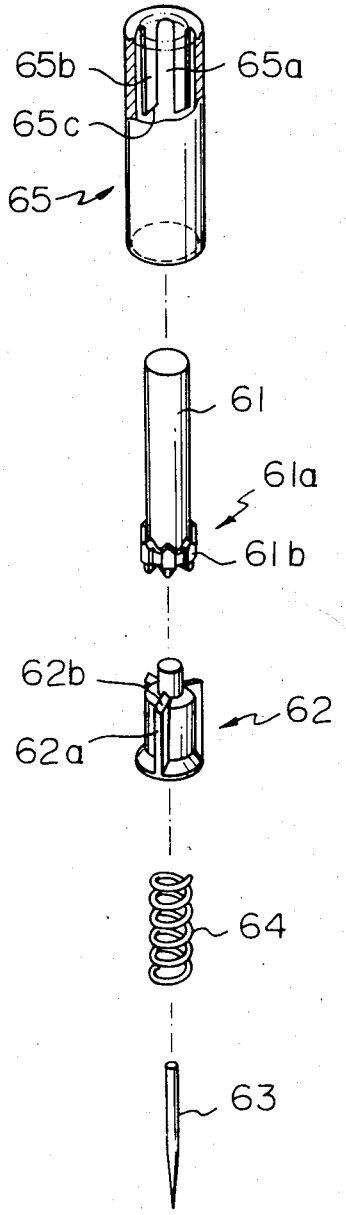
FIG. 16 is an exploded perspective view of another securing means suitable for the present invention.
Figure 18:
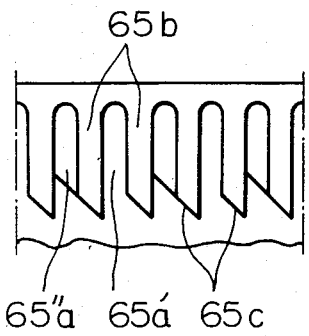
FIG. 18 is a development of part of the guide cylinder illustrating the grooves and the ribs thereof.
Figure 17:
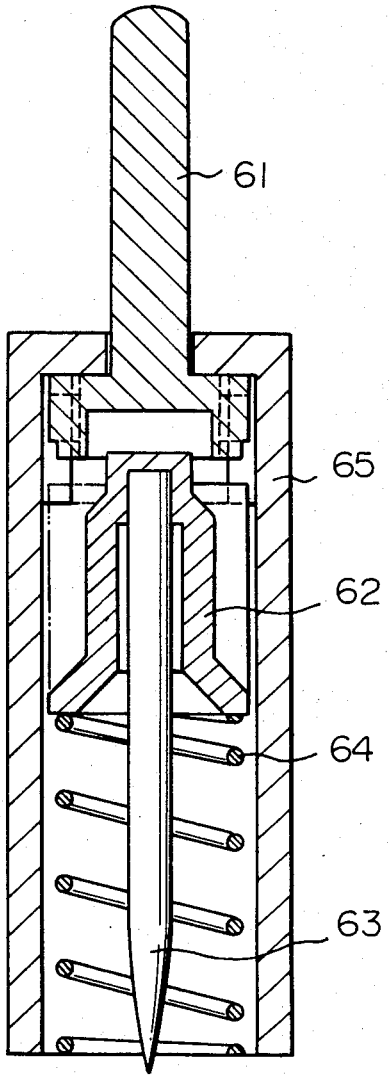
FIG. 17 is a sectional view of the securing means shown in FIG. 16.

In FIGS. 16 through 18 illustrate another embodiment of the securing means. As shown in FIG. 16, the securing means consists of a push rod 61, a rotor 62, a pin 63, a spring 64 and a guide cylinder 65 in which the three parts 61, 62 and 63 are movably built-in as shown in FIG. 17. The push rod 61 has a gear shaped portion 61*a* with six teeth 61*b* in a circumference thereof. Each of the teeth 61*b* slidably engages to each of grooves 65*a* provided longitudinally in an upper half of an inner wall of the guide cylinder 65. Each projection between the two adjacent grooves 65*a* constitutes each of six ribs 65*b* having a tapered lower end 65*c*. The grooves 65*a* are so arranged that the deeper one 65'*a* and the shallower one 65''*a* are alternately disposed. The rotor 62 abuts the gear-shaped portion 61*a* of the push rod 61 with frictional contact. The rotor 62 has three teeth 62*a* equidistantly arranged in the circumference thereof. The teeth 62*a* can be engageable only to the deeper groove 65*a* but not to the shallower one due to their size. Further, each of the teeth 62*a* has a knife edge-like top engageable to the tapered end 62*c*. The pin 63 is fixed to a center hole of the rotor 62. The spring 64 is located between the rotor 62 and the bottom wall of the cylinder 65 so that the rotor 62 and the push rod 61 are upwardly biased.

The cylinder 65 is embedded in the core body 3 in the same manner as the nuts 8*a* and 8*b* of the first embodiment.

In a non-operative condition, the teeth 62*a* of the rotor 62 are engaged to the deeper grooves 65'*a*. Accordingly, the rotor 62 is pushed up to the utmost position of the groove 65'*a* and the pin 63 retreats in the cylinder 65.

When the rear end of the push rod 61 projected from the cylinder 65 is pushed down against the upward force of the spring 64, the rotor 62 also moves downward along the deeper grooves 65'*a* and finally disengages therefrom. Due to this motion, the pin 63 protrudes from the cylinder 65 and secures the narrow band 2*b* in the channel 5*a*.

When the pushing action to the push rod 61 is released, the rotor 62 and the pin 63 tend to return to the original position due to the spring force. The knife edge-like top end 62*c* is forced to contact the tapered end 65*c* of the rib 65*b* and, as a result, a torque is exerted on the teeth 62*a*. Due to this torque, the rotor 62 rotates in a 60 degrees arc corresponding to an angle of one of the grooves 65*a*.

Thereby, the returning motion of the rotor 62 is blocked by the shallower groove 65''*a* and the operative position of the pin 63 is maintained.

Another push of the push rod effects the same action on the rotor as described above and the teeth 62*a* is engageable again to the deeper grooves 65'*a*, thereby the pin 63 can return to the non-operative position.

Figure 11:
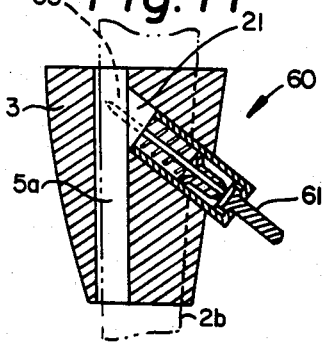

Instead of the pin, a presser with a frictional head may be utilized for exerting suitable braking force on the narrow band 2*b*. As shown in FIG. 11, the securing means 60 is built into the core body 3 in a manner similar to the embodiment of FIG. 8 so that the pin or presser head extends into the channel 5 when in the operative position.

Figure 10:
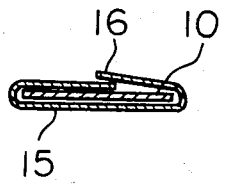
FIG. 10 is a sectional view of the narrow band showing an interlining.
Figure 12:
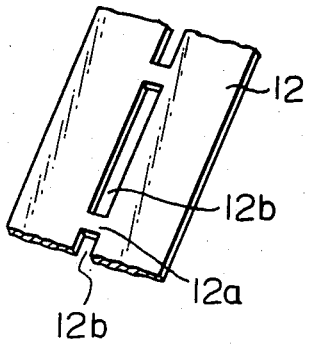
FIGS. 12 and 13 are perspective views of different embodiments of interlinings suitable for the present invention.
Figure 13:
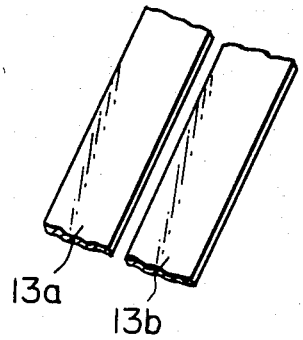

The present invention can be applied to a tie body 2 having a conventional interlining structure as shown in FIG. 10, in which a plain interlining 10 is wrapped by an outer cloth 15, both edges 16 of which are sewn together with the lining 10 along the center line of the back side of tie body 2. However, to enhance the effect of the channel 5*a* for folding the narrow band 2*b*, a certain length of the narrow band 2*b* which has to slide through the channel 5*a* when fitting and removing of the tie preferably has an improved interlining. FIGS. 12 and 13 illustrate various types of the interlinings suitable for achieving the abovesaid purpose.

The lining 12 shown in FIG. 12 has a plurality of long apertures 12*b* linearly arranged along the center line of the lining, each two adjacent apertures 12*b* being separated by a short bridge 12*a*. The lining 12 is also easily foldable along the aperture 12*b*.

FIG. 13 illustrates a lining which is completely divided into two parts 13*a* and 13*b* in the shape of narrow tapes.

The linings 11, 12 and 13 may be prepared separately from an ordinary lining utilized in other portions of the tie body, however, it is convenient to be formed as a part of the ordinary lining, in which part the groove or aperture is provided.

Figure 14:
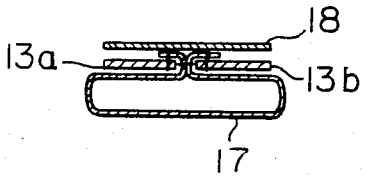
FIG. 14 is a sectional view of the process of making a narrow band comprising the interlining shown in FIG. 13.

These linings can be sewn with the outer cloth in the same manner as described with reference to FIG. 10. The following process, explained with reference to FIG. 14, however, is preferable to make the band 2*b*, particularly with the interlining 13.

Figure 15:
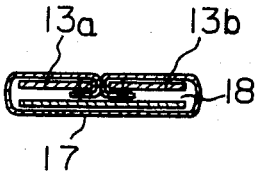
FIG. 15 is a sectional view of the completed narrow band shown in FIG. 14.

1. Folding an outer cloth 17 in such a manner that an inner surface thereof is exposed, and sewing the edges thereof together to form a tube thereof, 2. Arranging the tapes 13*a* and 13*b* along the both side of the stitch line of the cloth 17 and doubling out each of the edges to wrap the tapes 13*a* and 13*b*, 3. Sewing or adhering the edges of the tapes 13*a* and 13*b* with the doubled out portions of the outer cloth 17, and 4. Turning the tube of the outer cloth 17 inside out so that the tapes 13*a* and 13*b* are inside and the proper surface of the outer cloth 17 is outside as shown in FIG. 15.

In this process, a backing cloth 18 may be applied on the lining 13 for reinforcement.

As being described above, since the main parts of the necktie assembly is made from conventional cloth of the same shape as utilized for a traditional necktie, the appearance and feel thereof are familiar to the wearer. Therefore, the necktie assembly will be welcomed, without reservation, by many consumers.

Further, since the knot is formed on a relatively rigid core body, its shape can be maintained without deformation even after repeated use. This feature can also be enhanced by the use of a harder lining in selected portions of the tie body.

Due to a well-constructed channel of the core body and a double foldable interlining, the narrow band is smoothly slidable through the knot while keeping the neatly folded shape thereof, which results in a constant elegant style of the necktie.

Moreover, when utilizing a securing means, the loop of the narrow band is fixed in size, and slippage between the knot and the narrow band can be suppressed, enabling a confortable fit around the neck. Contrary to this, when one wishes to detach the tie, it can be easily removed by disengaging the securing means from the narrow band and enlarging the loop size. This removing operation can be enhanced by provision of the detachable fastener means midway of the loop.

I claim:

1. A necktie assembly comprising a tie body consisting of wide and narrow bands that are longitudinally connected to each other, said narrow band having an interlining with a longitudinal slot along at least a portion thereof, and a core body provided with a channel of U-shaped cross section, said tie body being tied around said core in a knot that is formed by longitudinally folding a portion of said narrow band along said slot and inserting said folded portion of said narrow band into said channel so that the longitudinally folded state of said band is maintained by engagement with a wall of said channel, wrapping a midportion of said tie body around said core body at least once to form a layer on said core body, and inserting a free end of said wide band between said layer and said core body from top to bottom.

2. A necktie assembly according to claim 1, in which said narrow band and said wide band are obliquely connected to each other.

3. A necktie assembly according to claim 1 or 2 in which said core body is provided with a means for securing said narrow band so as not to slide through said channel.

4. A necktie assembly according to claim 3, in which said securing means is a combination of a movable body and a holder thereof built-in said core body.

5. A necktie assembly according to claim 4, in which said movable body is a pin which can penetrate through said narrow band in said channel.

6. A necktie assembly according to claim 1 or 2, in which said wide and narrow bands are connected to one another by means of a detachable fastening means.

* * * * *